US007219751B2

(12) United States Patent
Velcover

(10) Patent No.: US 7,219,751 B2
(45) Date of Patent: May 22, 2007

(54) APPARATUS FOR GUIDING AND STEERING AN EARTH BORING MACHINE AND CASING ASSEMBLY

(76) Inventor: David Velcover, 2013 Horizon Ct., Zion, IL (US) 60099

( * ) Notice: Subject to any disclaimer, the term of this patent is extended or adjusted under 35 U.S.C. 154(b) by 320 days.

(21) Appl. No.: 10/939,558

(22) Filed: Sep. 13, 2004

(65) Prior Publication Data

US 2006/0054360 A1 Mar. 16, 2006

(51) Int. Cl.
*E21B 7/20* (2006.01)

(52) U.S. Cl. ..... 175/171; 175/45; 175/73

(58) Field of Classification Search ..... None
See application file for complete search history.

(56) References Cited

U.S. PATENT DOCUMENTS 3,938,597 A * 2/1976 Richmond et al. ..... 175/24
4,013,134 A * 3/1977 Richmond et al. ..... 175/73
4,977,967 A 12/1990 Alston et al.
5,470,132 A * 11/1995 Cartwright ..... 299/56

* cited by examiner

*Primary Examiner*—Frank Tsay
(74) *Attorney, Agent, or Firm*—Joseph S. Heino; Patrick M. Bergin

(57) ABSTRACT

A steering head that comprises a forward pivot block and a rearward pivot block. The forward pivot block is attached to a leading edge of a casing. The rearward pivot block is attached to a trailing portion of the casing, the leading edge being separated from the trailing portion by a gap in the casing. Extending between the forward and rearward pivot blocks is a central drive shaft. The central drive shaft includes a threaded portion and is rotatable to move a drive nut away from or towards the rearward pivot block. The central drive shaft, to either side of the drive nut, is covered by a cylindrical sleeve. A second internal sleeve extends between the rearward pivot block and the drive nut to protect the threads of the drive shaft from earthen debris when the casing is being advanced or reversed to steer the forward-most casing portion during operation.

14 Claims, 3 Drawing Sheets

APPARATUS FOR GUIDING AND STEERING AN EARTH BORING MACHINE AND CASING ASSEMBLY

FIELD OF THE INVENTION

The present invention relates generally to earth boring machines that are used to bore a substantially horizontal, and longitudinally extending, hole through the earth. It also relates generally to such machines where sections of pipe casing are concomitantly pushed into the horizontal hole to create a continuous casing within the bore. More particularly, it relates to an improved apparatus for guiding and steering a forward-most section of a pipe casing such that the hole and pipe direction are controlled during the boring process, which apparatus is resistant to seizing due to the presence of earthen debris that surrounds the apparatus.

BACKGROUND OF THE INVENTION

Earth boring machines that are used to create a horizontal bore, the bore being lined with a pipe casing, are well known in the art. Earth boring machines of this type typically utilize an auger at the forward, or leading, end of the pipe casing. The auger is rotated, thereby boring a horizontally disposed hole through the earth, the auger also carrying the dirt outwardly for disposal at rearward-most portion of the boring machine. Also at the boring machine, hydraulic pistons are used to drive the pipe casings through the bore as it is formed. Successive pipe casings are then attached to the series of end-to-end pipe casings as the bore progresses. In this fashion, a continuous bore and casing is made as desired or required for the particular application.

In order to achieve a final bore that is on grade, however, a steering head is typically located at the forward-most pipe casing or portion thereof. The steering head can be provided with a directional control device. This is also known in the art. One such control device is disclosed in U.S. Pat. No. 4,977,967 issued to Alston et al. In that type of device, a casing extension is pivotally attached to one end of a casing section and is controlled by an elongate tube that is movable along an axis that is generally parallel to the axis of the casing in order to pivot the casing extension upwardly or downwardly. A first connector for connecting one end of the tube to the casing extension and a second connector assembly connected to the other end of the tube for moving the tube and pivoting the casing extension is provided.

In the experience of this inventor, one difficulty encountered with the utilization of a steering head as described above is that a reversal of the steering head during the boring process tends to deposit earth into the drive mechanism, which is a threaded screw mechanism. The presence of earthen debris about the drive mechanism can cause the mechanism to seize when the boring head is re-activated to move forwardly. When this happens, the steering head mechanism will be inoperative, bring the boring process to a halt until the steering head mechanism can be cleaned or replaced. In the process of boring, cleaning of the steering head mechanism can create unacceptable down time. And if the steering head mechanism needs to be replaced, this creates unacceptable and unnecessary expense.

What is needed is a steering head mechanism that can be used with an earth boring machine such that the earth boring machine can be periodically reversed without causing the steering head mechanism to seize. What is also needed is such a steering head mechanism that is relatively easy and inexpensive to manufacture and which can be used in the same manner as current steering head mechanisms are used.

SUMMARY OF THE INVENTION

Accordingly, a primary objective of the device of the present invention is to provide a new, useful and heretofore unobvious steering head mechanism that can be used with an earth boring machine such that the earth boring machine can be periodically reversed without causing the steering head mechanism to seize during operation. A second objective is to provide such a steering head mechanism that is comprised of a minimum number of parts, thus making it relatively easy and inexpensive to manufacture. Another objective is to provide such a steering head mechanism that requires a minimum number of steps to use and which can be used in essentially the same manner, and in the same environment, as current steering head mechanisms are used.

In accordance with the aforementioned objectives of the present invention, there is provided a head steering mechanism that comprises a forward pivot block and a rearward pivot block. The forward pivot block is attached to a leading edge of a casing and the rearward pivot block is attached to a trailing portion of the casing, the leading edge being separately from the trailing portion and being horizontally adjustable relative to it. Extending between the forward and rearward pivot blocks is a central drive shaft. The central drive shaft includes a threaded portion and is rotatable so as to be able to move a drive nut in a longitudinal direction away from or towards the rearward pivot block. The threaded portion of the central drive shaft, to either side of the drive nut, is covered by a cylindrical sleeve. Another internal sleeve extends between the rearward pivot block and the drive nut to protect the threads of the drive shaft regardless of whether the mechanism is being advanced or reversed to steer the forward-most casing portion during operation. In this fashion, earthen debris is prevented from contact with the threaded drive shaft, thus allowing the steering head mechanism to operate reliably in both directions and without the possibility of causing the mechanism to seize.

The foregoing and other features of the apparatus of the present invention will be apparent from the detailed description that follows.

DETAILED DESCRIPTION

Figure 1:
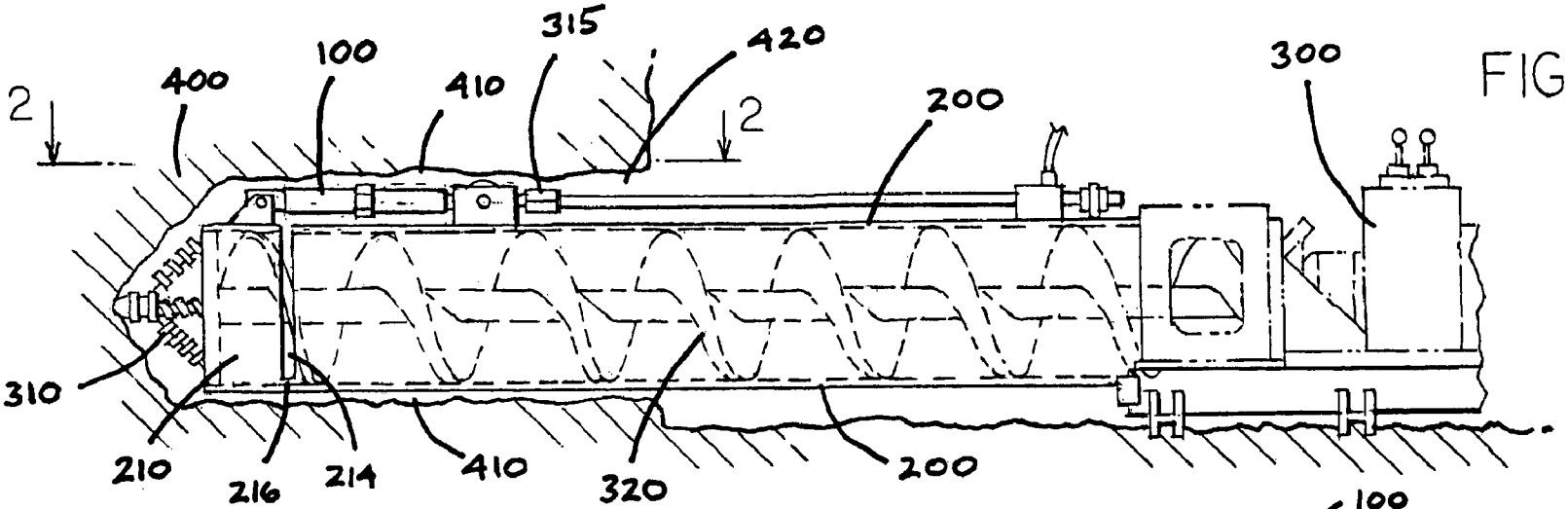
FIG. 1 is a side elevational view of a boring machine using the improved steering head mechanism of the present invention as attached to the foreward-most portion of a casing.
Figure 2:
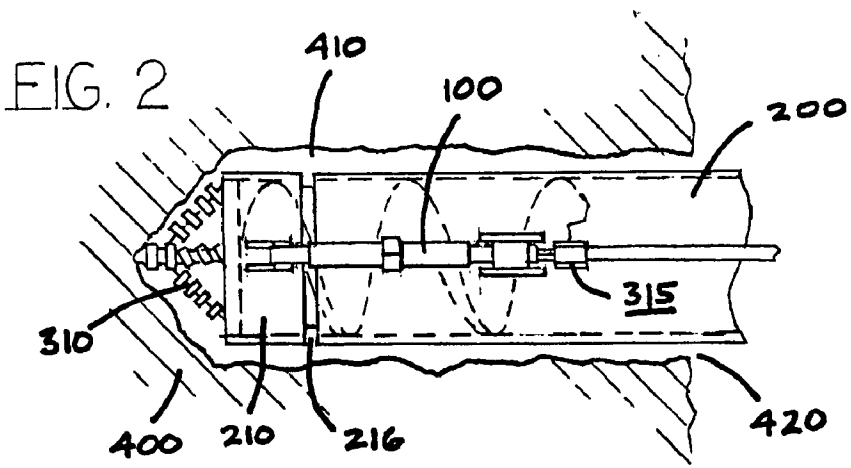
FIG. 2 is a top plan view taken along line 2—2 of FIG. 1.

Referring now to the drawings in detail, wherein like numbered elements refer to like elements throughout, FIGS. 1 and 2 illustrate a steering head mechanism, generally identified 100, constructed in accordance with the present invention. As shown, the steering head mechanism 100 is utilized with a boring machine 300 and its related components that are used for cutting a bore 410 into the earth 400.

More specifically, it will be seen that the steering head mechanism 100 is attached to the foremost portion 210 of a longitudinally extending casing 200. The casing 200 is an elongate hollow pipe casing of conventional type and length that projects into the bore 410 within the earth 400. Forward of the casing 200 is an auger bore head 310. An auger 320 is rotated within the casing 200 to move debris through the casing 200 as it is loosened by the bore head 310. The auger 320 and bore head 310 are rotatably driven by the boring machine 300 which is located at the opening 420 of the bore 410. It is to be understood that the precise type of boring machine 300 that can be used with the device of the present invention is not a limitation of the present invention. It is also to be understood that the device of the present invention is not limited to use with a single casing 200 and that, after the casing 200 is inserted into the bore 410, a second casing 200 will be attached to it and an additional auger 320 section will be added, and so on to the point that multiple casings 200 and auger sections 320 are used until the desired or required length of the bore 410 is reached and the bore 410 is completed.

Figure 8:
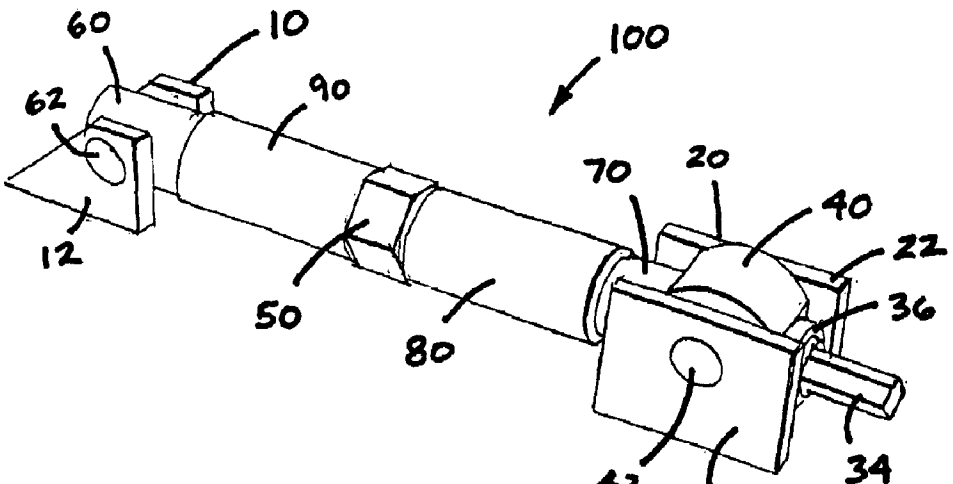
FIG. 8 is a rear, side and top perspective view of the steering mechanism constructed in accordance with the present invention.

Referring now to FIG. 8 which illustrates the steering head 100 in an unattached state, it will be seen that the steering head mechanism 100 includes a forward pivot block 10 and a rearward pivot block 20. See also FIG. 4. The forward pivot block 10 is comprised of a pair of parallel block plates 12, each block plate 12 being fabricated of a metal material. In the steering head 100 of the present invention, the block plates 12 are positioned parallel planar to one another. See also FIG. 5. Each forward pivot block plate 12 includes a tapered leading edge 14 and a flat foot portion 16. This tapered leading edge 14 facilitates movement of the head 100 through the earth 400 and along the bore 410. The foot portion 16 of each plate 12 is located generally parallel to the outer surface of the main casing 200, which casing 200 is typically made of a cylindrical metal material. Accordingly, attachment of the plate 12 to the casing 200 is best accomplished by welding. In particular, the foot portion 16 of each plate 12 is functionally adapted to be attached, generally perpendicularly, to the short forward-most casing piece 210 of the main casing 200. Each plate 12 of the forward pivot block 10 also includes a generally perpendicular aperture 18 defined within the plate 12. The apertures 18 of the plates 12 are co-linear along their respective axes in order to accommodate placement of a rod-like retention device through them, as will be discussed later in this detailed description.

Referring again to FIG. 8, it will be seen that the rearward pivot block 20 includes a pair of rearward pivot block plates 22, each of which is parallel planar to the other and each of which is preferably fabricated of metal material. See also FIGS. 4 and 5. Each plate 22 includes a foot portion 24 and a generally perpendicular aperture 26. The apertures 26 of the plates 22 are co-linear. The foot portions 24 of the plates 22 of the rearward pivot block 20 are functionally adapted to be attached, generally perpendicularly, to a rearward portion of the casing 200, preferably by welding.

Figure 3:
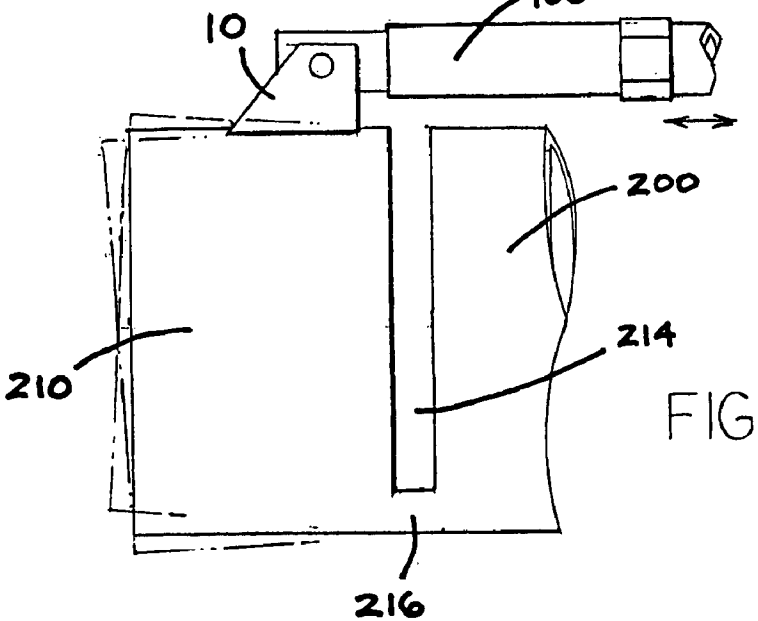
FIG. 3 is an enlarged side elevational view of the foreward-most casing portion with the steering head mechanism attached to it.

Referring now to the detail shown in FIG. 3, it will be seen that a casing slit or gap 214 separates the rearward main portion of the casing 200 and a short forward-most casing piece 210. This slit or gap 214 is really a partial "cut-through" in the casing 200 which connects the rearward portion of the casing 200 and the short casing piece 210 by means of a connector 216 that is opposed 180° relative to the position of the steering head 100. The purpose and advantage of this connector 216 will be further apparent later in this detailed description. It is the short casing piece 210 that the forward pivot block 10 is attached to in the preferred embodiment. It is to be understood, however, that the short casing piece 210 and the main casing 200 could be connected by other means that would provide flexing between those two components.

Referring again to FIGS. 4, 5 and 8, it will be seen that, disposed between the parallel planar plates 12 of the forward pivot block 10, there is located a cylindrically shaped, and substantially solid, first pivot block member 60. This pivot block member 60 is, in the preferred embodiment, a cylindrically shaped piece of metal material that is rotatably secured between the plates 12 by means of a pivot block pin 62. The pin 62 is insertable through the plate apertures 18 and welded 68 at each end to secure it in place. The first pivot block member 60 further includes a rearward portion 64. It should also be noted here that, in the preferred embodiment, close tolerances are to be followed to allow for proper movement and rotation of the various elements in relation to each other and to prevent earthen debris from working its way into and between those elements.

Disposed between the parallel planar plates 22 of the rearward pivot block 20 is a second pivot block member 40. The rearward second pivot block member 40 is rotatably attached to the plates 22 by means of a pair of opposing block keeps 42, each of which is disposed to either side of the block member 40. The second pivot block member 40 also includes a forward flat 44, a rearward flat 46, and a centrally disposed aperture 48. The purpose and function of each of these elements will become apparent later in this detailed description.

Figure 5:
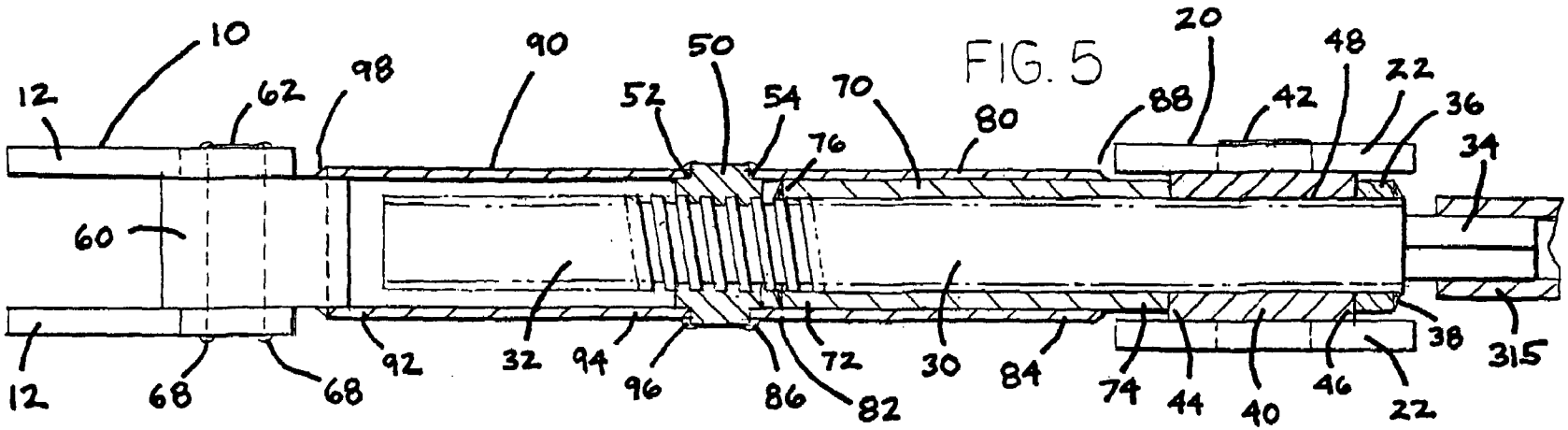
FIG. 5 is a partially sectioned top plan view of the steering head mechanism shown in FIG. 4.
Figure 4:
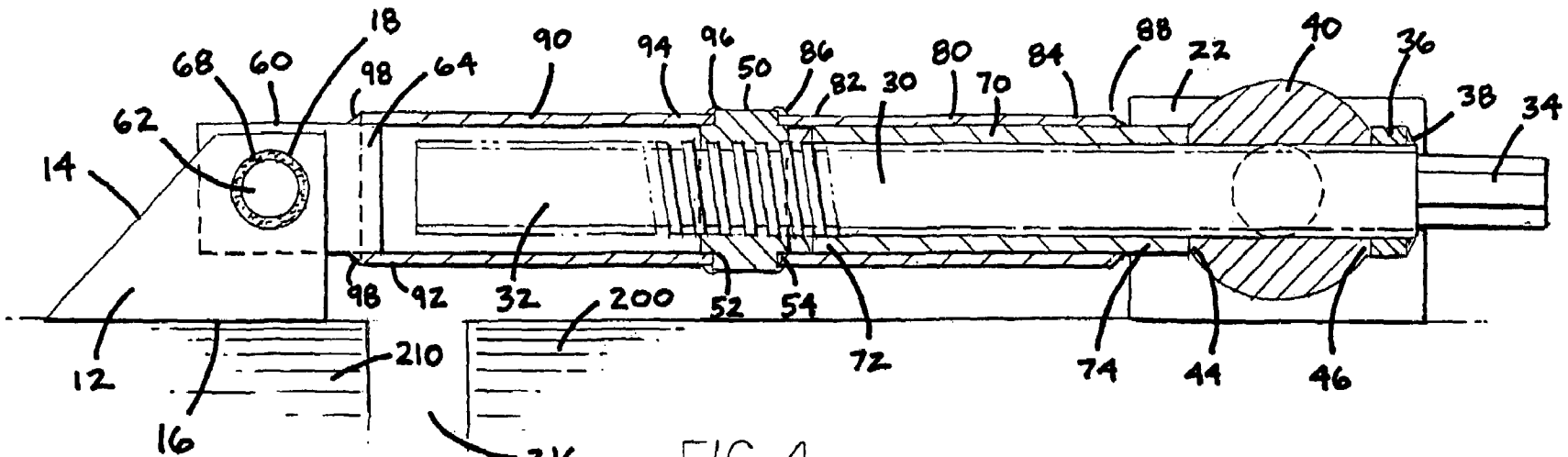
FIG. 4 is a further enlarged and partially sectioned side elevational view of the steering head mechanism of the present invention.
Figure 6:
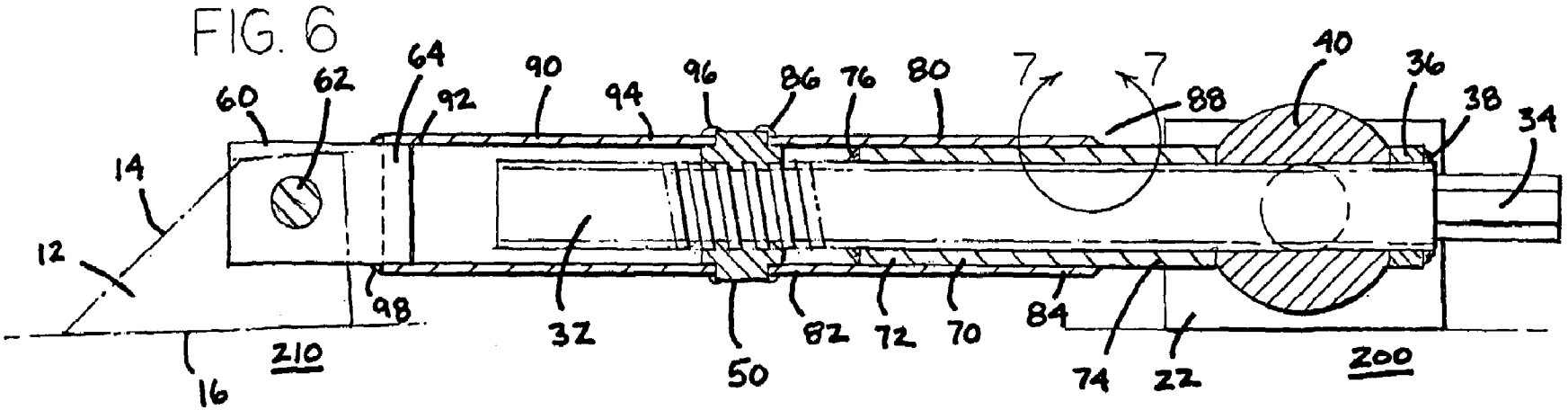
FIG. 6 is another partially sectioned side elevational view of the steering head mechanism shown in FIG. 4 and illustrating the mechanism in a second position.

The steering head mechanism 100 of the present invention also includes a longitudinally extending central drive shaft 30 having a forward portion 32 and a rearward portion 34. See FIGS. 4 and 5. The forward portion 32 of the central drive shaft 30 is threaded. In the preferred embodiment, the central drive shaft 30 is fabricated of a metal material with the threads of the threaded forward portion 32 being ACME threads. The rearward portion 34 of the central drive shaft 30 is configured in a substantially hexagonal cross section such that the rearward portion 34 can be driven by a female hexagonal member 315, as shown in FIG. 1. The rearward portion 34 of the central drive shaft 30 further includes a ring 36 that is secured by weldment 38 at the rearward most threaded portion 34 of the central drive shaft 30. The ring 36 is provided to prevent the passage of earthen debris into the threaded portion 32 of the drive shaft 30. The presence of the ring 36 also prevents forward movement of the central drive shaft 30 as the hexagonally shaped rearward portion 34 is rotated, thereby rotating the central drive shaft 30 about its axis during normal operation of the steering head mechanism 100. A portion of the central drive shaft 30 extends through the rearward block aperture 48 as alluded to earlier and as is shown in FIGS. 4, 5 and 6.

The forward portion 32 of the central drive shaft 30 also extends through a threaded drive nut 50. In the preferred embodiment, the drive nut 50 includes a forward shoulder 52 and a rearward shoulder 54. See FIGS. 4 and 5. In the steering head mechanism 100 of the present invention, it is important that each shoulder 52, 54 be machined into the drive nut 50 to form a circular surface to either side of the nut 50. The reason for this is that each shoulder 52, 54 is provided to allow a pair of outer sleeves 80, 90 to be secured to the nut 50, as will be explained shortly.

Extending between the forward most portion 44 of the rearward pivot block member 40 and the drive nut 50 is an inner sleeve 70 that surrounds the central drive shaft 30. In the preferred embodiment, the inner sleeve 70 is a cylinder made of a metal material. The inner sleeve 70 has a forward end 72 and a rearward end 74. The forward end 72 of the inner sleeve 70 is welded 76 to the central drive shaft 30 at a point that is just behind the rearward facing surface 56 of the drive nut 50. The position of the weld 76 is according to a predetermined distance of the drive nut 50 from the second pivot block member 40, which distance coincides with the length of the inner sleeve 70. The rearward end 74 of the inner sleeve 70 abuts the front face 44 of the rearward pivot block member 40 and is rotatably movable in respect to it. In this fashion, that portion of the drive shaft 30 which is threaded and which lies beneath the inner sleeve 70 is completely protected from its working environment.

Figure 7:
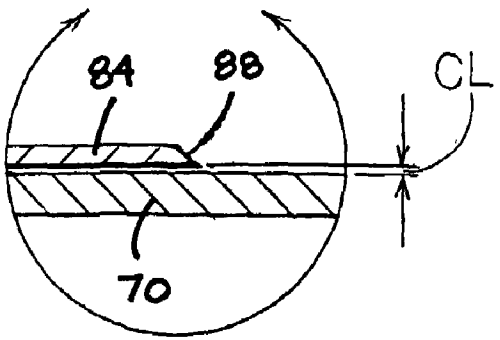
FIG. 7 is a greatly enlarged view taken along arcuate line 7—7 of FIG. 6 and showing detail of the cooperating sleeves used in the mechanism.

Extending in the same fashion between the drive nut 50 and the rearward pivot block member 40 is a first outer sleeve 80. The first outer sleeve 80 is a cylinder, of slightly greater diameter than that of the inner sleeve 70, and is made of a metal material. The first outer sleeve 80 includes a forward end 82 and a rearward end 84. The forward end 82 of the first outer sleeve 80 is welded 86 about its perimeter to the rearward facing drive nut shoulder 54. In this fashion, the first outer sleeve 80, including the rearward end 84 of it, is able to slide in extremely close tolerance along the inner sleeve 70. This is shown by the letters and dimension CL in FIG. 7. It is to be understood that the inner diameter of the first outer sleeve 80 closely approximates the outer diameter of the inner sleeve 70 so as to prevent the entry of earthen debris between those two cooperating parts. In the preferred embodiment, the rearward end 82 of the first outer sleeve 80 is chamfered 88 to allow that end 82 to move easily through earthen debris when the first outer sleeve 80 is moved backwardly over the inner sleeve 70. Although not shown, a brush or seal could be interposed between the inner sleeve 70 and the first outer sleeve 80 in order to facilitate the resistance of debris penetration between those two component parts.

Disposed between the drive nut 50 and the rearward portion 64 of the forward pivot block member 60 is a second outer sleeve 90, the second outer sleeve 90 being a cylinder of substantially the same diameter as the first outer sleeve 80 and being made of a metal material. The second outer sleeve 90 similarly includes a forward end 92 and a rearward end 94. The rearward end 94 of the second outer sleeve 90 is secured, preferably by welding 96 about its perimeter, to the forward facing drive nut shoulder 52. The forward end 92 of the second outer sleeve 90 is similarly welded 98 about its perimeter to the rearward portion 64 of the first pivot block member 60. In this fashion, the threaded portion 32 of the central drive shaft 30 that lies beneath the second outer sleeve 90 is completely protected from earthen debris.

In application, the forward pivot block plates 12 of the steering head mechanism 100 are welded to a forward-most portion 210 of a main casing 200. The boring head 310 is located at this forward-most portion 210. As dirt and earth are loosened at the auger 320, this debris is passed through the casing 200 and discarded. It will be recalled that the rearward pivot block plates 22 of the mechanism 100 are similarly welded to the main casing 200 at some point behind the casing slit 214.

At some point during the boring process, it may be necessary to change the pitch of the axis of the bore 410 either upwardly or downwardly, as required. Due to the weldment positions of the forward pivot block 10 and the rearward pivot block 20, the axis of the forward-most portion 210 of the main casing 200 and the axis of the main casing can be varied by lengthening the distance between the forward and rearward pivot blocks 10, 20 or by shortening that distance. This, in turn, affects the width of the slit or gap 214. If the distance is lengthened, and the width of the slit or gap 214 at the point of the steering head mechanism 100 is enlarged, then the forward-most portion 210 will begin a descent of the casing 200, whereas a shortening will begin an ascent of the casing 200. See FIG. 3. A lengthening of that distance will occur when the rearward hexagonal portion 34 of the central drive shaft 30 is rotated, for example, clockwise. This clockwise rotation, in turn, causes the drive nut 50 to move away from the rearward pivot block 20 and taking with it the first and second outer sleeves 80, 90 that are welded to it. This action also allows the first outer sleeve 80 to slide over the outer surface of the inner sleeve 70, thereby exposing the inner sleeve 70 to earthen debris but not exposing the threaded portion 32 of the central drive shaft 30.

If, during the boring process, it becomes necessary to reverse the rotation of the central drive shaft 30, this moves the forward pivot block 10 towards the rear pivot block 20 and reverses the direction of travel of the drive nut 50. This also causes the first outer sleeve 80 to slide back over the inner sleeve 70 towards the rear pivot block 20. Any earthen debris that is in contact with the inner sleeve 70 is gently urged away from the inner sleeve 70 outer surface 78 by means of the chamfered end 88, thus allowing the mechanism 100 to be reversed and the direction of travel of the auger 300 and casing 200 to be altered relative to the horizontal. By keeping earthen debris away from the threaded surface 32 of the drive shaft 30 and the drive nut 50, there is no chance of the mechanism 100 seizing during normal operation due to the presence of that debris within the device.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

From the foregoing detailed description of the illustrative embodiment of the invention set forth herein, it will be apparent that there has been provided a new, useful and uncomplicated steering head mechanism that can be used with an earth boring machine such that the earth boring machine can be periodically reversed without causing the steering head mechanism to seize during operation; that is comprised of a minimum number of parts, thus making it relatively easy and inexpensive to manufacture; and that requires a minimum number of steps to use and which can be used in essentially the same manner, and in the same environment, as current steering head mechanisms are used.

The principles of this invention having been fully explained in connection with the foregoing, I hereby claim as my invention:

1. A steering head for use with a boring machine that allows a casing to be placed within a bore in the earth which comprises:

a forward pivot block;

a rearward pivot block;

a central drive shaft, said drive shaft having a threaded portion and means for rotating the drive shaft bi-directionally to move the forward and rearward pivot blocks toward or away from each other;

a drive nut, said drive nut including a threaded aperture, which threads correspond to those of the threaded portion of the central drive shaft; and a thread covering comprising a sleeve surrounding the threaded portion of the central drive shaft for preventing earthen debris from accessing the threads of the drive shaft and of the drive nut;

wherein the casing includes a transverse gap within it, the forward pivot block is attached to the casing to one side of the gap and the rearward pivot block is attached to the casing to the other side of the gap, and the gap width is variable with rotation of the central drive shaft.

2. The steering head of claim 1, wherein the thread covering further comprises a first outer sleeve surrounding the threaded portion of the central drive shaft and extending between the rearward pivot block and the drive nut.

3. The steering head of claim 2 wherein the thread covering means further includes a second outer sleeve, said second outer sleeve having an inner diameter that is approximately the same diameter as the outer diameter of the first outer sleeve.

4. The steering head of claim 3 wherein the first outer sleeve includes a first end and a second end, said first outer sleeve second end abutting the rearward pivot block and said first outer sleeve first end being attached to the threaded portion of the drive shaft.

5. The steering head of claim 4 wherein the second outer sleeve includes a first end and a second end, the first end of said second outer sleeve being attached to the drive nut whereby the drive nut and the second outer sleeve move along the drive shaft as one unit.

6. The steering head of claim 5 wherein the second end of the first outer sleeve includes a chamfered end.

7. A steering head for use with a boring machine that allows a casing to be placed within a bore in the earth, wherein the casing includes a longitudinally extending main casing portion and a shorter leading casing portion connected to the main casing by a flexible connector, the steering head comprising:

a forward pivot block, the forward pivot block being attached to the leading casing portion;

a rearward pivot block, the rearward pivot block being attached to the main casing portion;

a central drive shaft, said drive shaft having a threaded portion and means for rotating the drive shaft bi-directionally;

a drive nut, said drive nut including a threaded aperture, which threads mesh with those of the threaded portion of the central drive shaft such that rotation of the drive shaft moves the drive nut in a longitudinal direction along the drive shaft; and a thread covering comprising a sleeve surrounding the threaded portion of the central drive shaft for preventing earthen debris from accessing the threads of the drive shaft and of the drive nut.

8. The steering head of claim 7, wherein the thread covering further comprises a first outer sleeve surrounding that portion the threaded portion of the central drive shaft that extends between the rearward pivot block and the drive nut.

9. The steering head of claim 8 wherein the thread covering means further includes a second outer sleeve, said second outer sleeve having an inner diameter that is approximately the same diameter as the outer diameter of the first outer sleeve.

10. The steering head of claim 9 wherein the first outer sleeve includes a first end and a second end, said first outer sleeve second end abutting the rearward pivot block and said first outer sleeve first end being attached to the threaded portion of the drive shaft at a point between the drive nut and the rearward pivot block, wherein movement of the first outer sleeve relative to the rearward pivot block is prevented.

11. The steering head of claim 10 wherein the second outer sleeve includes a first end and a second end, the first end of said second outer sleeve being attached to the drive nut whereby the drive nut and the second outer sleeve move along the drive shaft as one unit.

12. The steering head of claim 11 wherein the second end of the first outer sleeve includes a chamfered end.

13. The steering head of claim 7 wherein the threads of the central drive shaft and the threads of the drive nut are meshing ACME threads.

14. The steering head of claim 7 wherein all elements are made of a metal material and all attachments are secured by weldment.

* * * * *